United States Patent [19]

Tauleigne

[11] 3,964,690

[45] June 22, 1976

[54] APPARATUS FOR FORMING A PIECING END ON A YARN WINDING

[75] Inventor: Rene Tauleigne, Valence, France

[73] Assignee: Rhone-Poulene-Textile, Paris, France

[22] Filed: Sept. 20, 1973

[21] Appl. No.: 399,111

[30] Foreign Application Priority Data

Sept. 22, 1972 France ..... 72.33927

[52] U.S. Cl. ..... 242/18 PW

[51] Int. Cl.[2] ..... B65H 54/02; B65H 54/34

[58] Field of Search ..... 242/18 PW

[56] References Cited

UNITED STATES PATENTS

| | | | |
|---|---|---|---|
| 3,166,262 | 1/1965 | Vanneman, Sr. | 242/18 PW UX |
| 3,275,252 | 9/1966 | Bolger | 242/18 PW |
| 3,282,516 | 11/1966 | Porter | 242/18 PW |
| 3,792,818 | 2/1974 | Bauer et al. | 242/18 PW |

*Primary Examiner*—Stanley N. Gilreath
*Attorney, Agent, or Firm*—Leonard W. Sherman

[57] ABSTRACT

An apparatus for forming a piercing end on a winding of yarn includes an auxiliary guide for engaging a strand of yarn and retaining the strand of yarn adjacent to one end of a spool core for a predetermined time interval. The auxiliary guide projects from a pivoted arm member, the motion of which is limited in one direction by a magnetic bar which attracts and holds the arm member, and is limited in the other direction by a stop which engages the arm member and rebounds the arm member back to the magnetic bar. In operation, the strand of yarn is entrained around the auxiliary guide and hooked by the spool core. When a predetermined tension is applied to the strand of yarn, the arm member will disengage from the magnetic bar, allowing the strand of yarn to move along the auxiliary guide until the strand leaves the end of the auxiliary guide. Just before the arm disengages from the magnet, a series of overlapping coils will form adjacent to the end of the spool core. When the arm member disengages from the magnetic bar and the yarn slides along the auxiliary guide, a series of coils of increasing pitch are then formed along the spool core. These windings form the piercing end. After the yarn is disengaged from the auxiliary guide, it is captured by a conventional reciprocating guide, which distributes the yarn along the spool to form the main winding.

1 Claim, 4 Drawing Figures

APPARATUS FOR FORMING A PIECING END ON A YARN WINDING

BACKGROUND OF THE INVENTION

This invention relates to apparatus for forming a piecing end on a winding of yarn. More particularly, this invention relates to an apparatus for forming a piecing end of a winding of yarn by initially engaging the yarn to be wound with an auxiliary guide means.

In the manufacture of textiles, yarn is packaged by initially winding the yarn on spool cores. These spool cores have a main winding which is distributed over most of the spool, and a secondary winding distributed adjacent to one end of the spool which is used to splice windings on separate spools together. The secondary winding is called a piecing end, or perhaps, a piecing winding or a reserve winding. It is preferable that this piecing end not be secured to the spool coil with any type of closed loop.

The prior art discloses numerous approaches to the problem of forming piecing ends; however, these prior art approaches are generally rather complicated and require precise control and precise positioning of the yarn path. The general approach, when winding yarn with a zero twist, is to engage the yarn with a mobile auxiliary guide which controls the yarn during the time the yarn is wound to form the piecing end, and then by some means, transfers the yarn to a main yarn guide.

One prior art approach uses a simple hook which holds the yarn during the formation of the piecing end, and then allows the yarn to escape when the hook is retracted. This type of device is described, for example, in French Pat. No. 1,403,007 and U.S. Pat. No. 3,065,921. These guides, however, require a precise positioning of the path of the yarn, which is time consuming and requires some type of electrical or mechanical control means to retract the hook. This, of course, complicates the design and structure of the piecing end forming device. Furthermore, with this type of device, it is only possible to make piecing ends having coils which are joined or looped. Since joined or looped coils are difficult to splice, this approach leaves much to be desired.

Another type of auxiliary guide utilizes a ramp along which the yarn slides to form the piecing end on the winding coil. This type of guide usually slides or pivots to cause the yarn to slide along the ramp. Devices of this type are disclosed, for example, in French Pat. No. 1,479,764 and U.S. Pat. No. 3,166,262. These devices, however, require complex mechanical and pneumatic control systems which are difficult to regulate and require frequent adjustment. Consequently, these devices are both expensive and not necessarily reliable. As with the hook type devices, the ramp type devices require precise positioning of the path of the yarn.

The prior art also includes rotary auxiliary guides which are helical in shape and are formed by the coils of a coil spring or the threads of a helically threaded rod. These rotary guides may be mounted to idle on a shaft so as to be rotated by frictional forces between the yarn and the guides as the yarn is coiled, or on the other hand, may be driven positively by a drive means such as an electric motor. This type of guide is described, for example, in French Pat. No. 1,354,056 and French Pat. No. 1,439,305. As with the hook and ramp type auxiliary guides, these rotary guides require precise positioning of the yarn along a predetermined path in order to operate. In addition, since the pitch of the helices formed on these guides is fixed, it is impossible to vary the length of the piecing end without changing the rotary guide. An additional problem with this type of guide is that complicated driving and controlling systems are necessary when these guides are rotated positively.

OBJECTS OF THE INVENTION

In view of the expense and complexity of the above-noted auxiliary guides, the apparatus of the instant invention was developed.

Accordingly, it is a primary object of the instant invention to provide an apparatus for forming a piecing end on a winding of yarn.

It is a further object of the instant invention to provide an auxiliary guide for forming a piecing end.

It is a still further object of the instant invention to provide a relatively simple and reliable auixilary guide for forming a piecing end.

It is an additional object of the instant invention to provide an auxiliary guide which requires neither precise positioning of the yarn that it engages, nor an external control system.

SUMMARY OF THE INVENTION

In accordance with these and other objects, the preferred form of apparatus of the instant invention includes a pivoted arm member having an auxiliary guide projecting therefrom, which initially engages and restrains a strand of yarn adjacent to one end of a spool core upon which the yarn is to be wound. The arm from which the auxiliary guide projects is restrained by a magnetic bar and a stop to pivot between two positions. Initially, the arm is held in the first position by magnetic attraction between the arm and the magnetic bar. While in this position, the auxiliary guide causes the strand of yarn to wrap several tight coils about the end of the spool core. While these coils are being formed, tension in the strand of yarn increases to a predetermined level and overcomes the magnetic attraction, causing the arm to disengage from the bar and the yarn to slide along the auxiliary guide, generating a series of coils on the spool core of increasing pitch. When the arm pivots to the second position and strikes the stop, the yarn disengages from the auxiliary guide and is captured by a main reciprocating guide, whereupon the arm rebounds from the stop and returns to its initial position in engagement with the magnetic bar. The piecing end having been formed, the main reciprocating guide assumes control of the yarn and generates the main winding as the spool rotates.

BRIEF DESCRIPTION OF THE DRAWINGS

The above objects and advantages of the apparatus for practicing the present invention will become more apparent from the attached drawings, wherein.

DETAILED DESCRIPTION OF THE INVENTION

Figure 1:
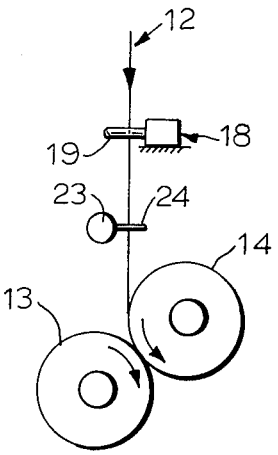
FIG. 1 is a diagrammatic side view of a winding station, including an auxiliary guide apparatus according to the instant invention.
Figure 2:
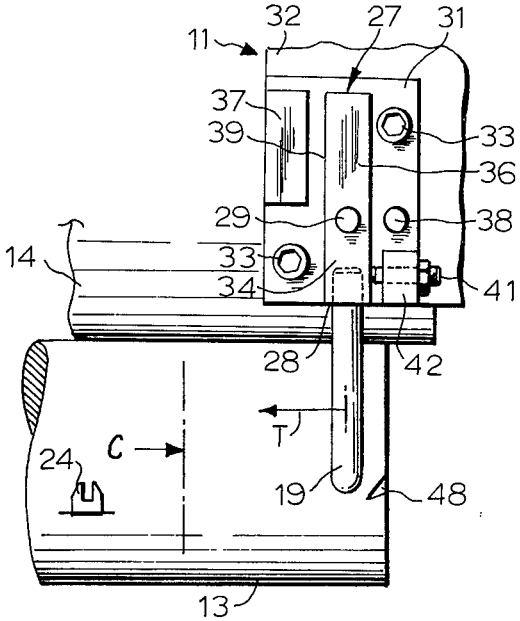
FIG. 2 is an enlarged partial top view of a winding station such as that shown in FIG. 1, and showing in more detail the auxiliary guide apparatus.

Referring now to FIG. 1, there is shown a winding station, designated generally by the numeral 11, for winding a strand of yarn, designated generally by the numeral 12, on a spool core 13. The spool core 13 is engaged by and frictionally driven to rotate in a clockwise direction by a friction drive roller 14. An auxiliary guide apparatus, designated generally by the numeral 18, initially engages the yarn 12 with an auxiliary guide 19 to form the piecing end 21 shown in FIG. 4. After the piecing end 21 is formed, a reciprocating device 23 captures the yarn 12 in a main guide 24 to distribute the yarn along the spool core 13 to form a main winding 26, also shown best in FIG. 4. As best seen in FIGS. 1 and 2, the auxiliary guide 19 is positioned above and in overlapping relationship with the main guide 24.

Referring now mainly to FIG. 2, wherein a preferred embodiment of the auxiliary guide apparatus 18 is shown in detail, there is shown an arm, designated generally by the numeral 27, which is made of a magnetic material, such as steel, and has the auxiliary guide 19 embedded in or otherwise rigidly secured to one end 28 thereof. The arm 27 is pivotted by vertical pivot pin 29 on a mounting plate 31 to rotate between first and second positions. The mounting plate 31 is secured to a fixed portion 32 of the winding station 11 by a pair of mounting screws 33-33 which are recessed into the plate 31. The arm 27 pivots in a horizontal plane and, when in the first position, projects in a direction normal to the axis of the spool core 13.

The pivot pin 29 divides the arm 27 into first and second sections or portions 34 and 36, respectively. The auxiliary guide 19 projects from the first section 34, while the second section 36 engages either a magnetic bar 37, which is rigidly secured to the mounting plate 31, or a stop 38, which is also rigidly secured to the mounting plate 31. The magnetic bar 37 preferably presents a flat surface against which a flat side 39 of the arm 27 will engage to hold securely the second section 36 of the arm against the magnetic bar with magnetic attraction. In order to adjust the force with which the magnetic bar holds the second section 36 of the arm 27 in position, a set screw 41 is positioned to engage the first section 34 of the arm on the side of the arm facing opposite side 39. The set screw 41 is threaded into a lug 42 which is rigidly secured to and projects up from the mounting plate 31. By turning the set screw 41 to advance toward the first section 34 of the arm 27, the amount of force holding the arm in engagement with the magnetic bar 37 will be reduced. On the other hand, when the set screw 41 is backed away from the arm 27, the amount of force with which the magnetic bar 37 holds the arm 27 is correspondingly increased. In this way, the amount of force necessary to pivot the arm 27 and thus the auxiliary guide 19 away from the magnetic bar 37 may be adjusted to a predetermined value.

Figure 3:
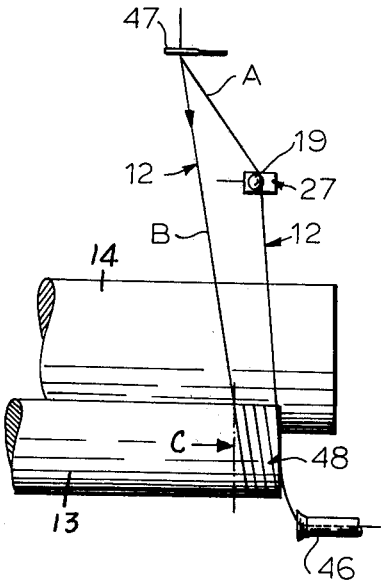
FIG. 3 is an elevation view of the winding station shown in FIG. 1, illustrating the paths taken by a strand of yarn on a spool core before and after formation of a piecing end.
Figure 4:
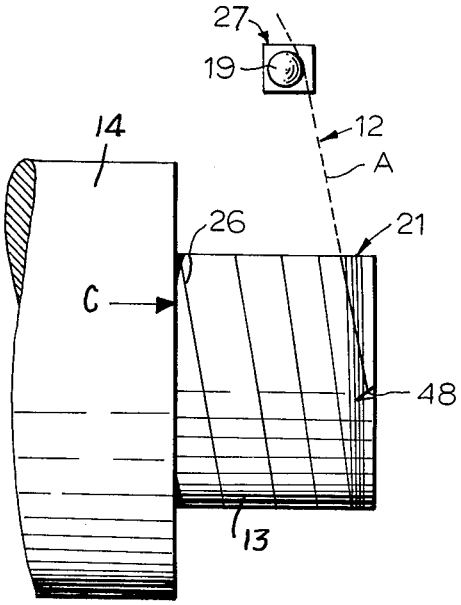
FIG. 4 is an enlarged elevational view of a portion of FIG. 3 showing the configuration of the piecing end generated by the auxiliary guide of the instant invention.

The operation of the afore-described device is best understood by reference to FIGS. 3 and 4. As shown in FIG. 3, the strand of yarn 12 which is being advanced from a feeder device (not shown), such as a drawing roll station, is captured by a pneumatic positioning gun 46 entrained through a convergence guide 47 and over the auxiliary guide 19 to follow a path A which terminates at the end of the spool core 13. In order to initially secure the yarn 12 to the spool core 13, the positioning gun 46 moves the yarn 12 so that it is hooked by a slit 48 formed in the end of the spool core 13.

In order to wind the yarn 12 on the spool core 13 rather than the friction drive roller 14, the spool core 13 is rotated at an overspeed in relation to the drive roller. By suitable means (not shown), this overspeed is approximately 4 percent greater than the rotational speed of the drive roller 14. The overspeed produces a high tension in the yarn 12 which, depending on the type of yarn being coiled, can reach a force of 100 g. This is considerably greater than the 15 g tension placed on the yarn 12 by the force exerted by the pneumatic positioning gun 46.

High tension on the yarn 12 exerts a force on the auxiliary guide 19 in the direction of the arrow T. This creates a moment which tends to rotate the arm 27 about the pivot pin 29. This moment, however, is opposed by the magnetic attraction between the magnetic bar 37 and the second section 36 of the arm 27. The force of this magnetic attraction is chosen to be less than the force exerted on the auxiliary guide 19 by the yarn 12. Fine adjustments in the magnetic force can be made by advancing or backing the adjustment screw 41, as heretofore described. Since the force on the auxiliary guide 19 is greater than the magnetic force on the arm 27, the arm 27 will disengage from the magnetic bar 37 and will pivot about the pivot pin 29 and away from the magnetic bar 37 as the magnetic force decreases parabolically.

There is a slight time lag between hooking the yarn 12 in the slit 48 and pivoting the arm 27 away from the magnetic bar 37. During this time interval, the yarn 12 accumulates several overlapping coils 21 on the end of the spool core 13, which secures the yarn 12 to the spool core and makes unnecessary the use of an auxiliary securing device, such as an adhesive patch.

When the tension on the yarn 12 builds up enough force to disengage the arm 27 from the magnetic bar 37, the arm 27 and the auxiliary guide 19 will pivot in a clock-wise direction, causing the yarn to slide down the auxiliary guide 19 and generate on the spool core 13 a series of non-overlapping coils having an increasing pitch. This forms the piecing end 26. When the yarn 12 disengages from the auxiliary guide 19, the main guide 24 captures the yarn and causes the yarn to follow a path B which distributes the yarn over the spool core 13 to form the main winding which is distributed to the left of line C on the spool core.

As the yarn 12 slides down the auxiliary guide 19 and pivots the arm 27, it also causes the second section 36 of the arm to strike the stop 38 and, when the yarn leaves the auxiliary guide to assume the path B, the arm recoils back into engagement with the magnetic bar 37, which holds the arm in the first position until it is needed to form a subsequent piecing end 21.

While the afore-mentioned rebound phenomenon has therefor proved sufficient to return the arm 27 to the magnetic bar, it might be advantageous to facilitate this return movement by means of a small coil spring (not shown) mounted on the pivot pin 29 to positively urge the arm into engagement with the magnetic bar.

EXAMPLE

The afore-described auxiliary guide apparatus 18 was used to form a piecing end for a coil of polyester yarn having a count of 167 dtex/30 strands, which was wound at a speed of 3,000 m/min. on a spool having a diameter of 100 mm and a length of 207 mm. In this case, the path of the main yarn guide 24 was 170 mm and the length of the auxiliary guide 19 was 15 mm. At an overspeed of the spool core 13 of 3 – 4.5 percent, the over-tension upon hooking the yarn 12 was about 50 g, and the winding tension was about 20 g. The force of magnetic attraction between the magnetic bar 37 and the arm 27 was adjusted with the set screw 41 to be between 10 – 30 g, depending on the path taken by the yarn and the positions of the auxiliary guide 19 and the convergence guide 47. When the afore-mentioned dimensions and conditions were coordinated, the winding station 11 reliably created piecing ends with minimum operator involvement.

While a single embodiment has been herein described and exemplified, numerous variations may be made in the above-described device. For example, the magnetic bar 37 may be an electromagnet instead of a permanent magnet, while several approaches may be used to regulate the force applied by the magnet. In addition, the shape of the auxiliary guide may be altered without departing from the spirit of this invention. The afore-described apparatus may be used on any suitable winding machine, but is is particularly suited to winding yarn delivered continuously from a spinning operation at high speeds of up to 6,000 – 7,000 m/min. or more. The afore-mentioned device is suitable for both continuous and fiber yarns, comprising any type of materials, such as natural and synthetic fiber, and also yarns of virtually any count, no matter how high or low. While the apparatus of the present invention has been illustrated by way of the foregoing drawings and embodiments, which are for purposes of illustration only, the apparatus of the present invention is to be limited only by way of the following appended claims.

I claim:

1. An apparatus for forming a piecing end for a main winding of yarn wound on a rotating spool, comprising:

a vertically extending pivot;

an arm means mounted for rotation about said pivot in a horizontal plane and at a point intermediate the opposite ends thereof, wherein said pivot divides said arm means into a first section and a second section of magnetic material;

a projection extending from one section of the arm means for engaging the yarn when the yarn is initially engaged with the spool prior to forming the main winding on the spool;

magnetic control means for engaging the second section of the arm means to both arrest pivotal motion of the arm means at a first position where the projection extends substantially normal to the axis of the spool and to hold the arm means in the first position while overlapping coils of yarn are formed on the spool, said control means holding said arm means until the yarn applies a predetermined threshold force to the projection to pivot the arm means, whereupon the yarn forms coils of increasing pitch on the spool until the yarn disengages from the spool to start forming the main winding, said magnetic control means including a magnet which magnetically attracts said second section of the arm means of magnetic material;

an adjustment means positioned to engage the first section of the arm to control the proximity of the second section to the magnet and thereby determine the magnitude of the predetermined force; and stop means spaced from the control means for engaging the second section of the arm means to arrest pivotal motion of the arm means at a second position and to rebound the arm means to the first position as the yarn disengages from the projecting portion whereby the piecing end being formed by orienting the arm means initially at an angle substantially perpendicular to the spool.

* * * * *